US005117905A

United States Patent [19]

Hesse

[11] Patent Number: 5,117,905

[45] Date of Patent: Jun. 2, 1992

[54] HEAT EXCHANGER WITH FINS

[75] Inventor: Wolfgang Hesse, Loeffingen, Fed. Rep. of Germany

[73] Assignee: Sueddeutsche Kuehlerfabrik Julius Fr. Behr GmbH & Co. KG, Stuttgart, Fed. Rep. of Germany

[21] Appl. No.: 230,413

[22] Filed: Aug. 10, 1988

[30] Foreign Application Priority Data

Aug. 29, 1987 [DE] Fed. Rep. of Germany ..... 3728969

[51] Int. Cl.[5] ..... F28F 1/24

[52] U.S. Cl. ..... 165/182; 165/151

[58] Field of Search ..... 165/182, 151

[56] References Cited

U.S. PATENT DOCUMENTS

| | | | |
|---|---|---|---|
| 2,737,370 | 3/1956 | Frisch et al. | 165/182 X |
| 3,205,936 | 9/1965 | Katz | 165/182 X |
| 4,428,418 | 1/1984 | Beasley et al. | 165/76 |

FOREIGN PATENT DOCUMENTS

| | | | |
|---|---|---|---|
| 79090 | 5/1983 | European Pat. Off. . | |
| 2123722 | 11/1972 | Fed. Rep. of Germany . | |
| 2527147 | 12/1976 | Fed. Rep. of Germany . | |
| 1174402 | 12/1969 | United Kingdom | 165/182 |
| 1415384 | 11/1975 | United Kingdom . | |
| 2047399 | 11/1980 | United Kingdom . | |
| 2110811 | 6/1983 | United Kingdom | 165/182 |

*Primary Examiner*—Gerald A. Michalsky
*Attorney, Agent, or Firm*—Foley & Lardner

[57] ABSTRACT

In order to be able to use materials of higher strength without the danger of cracks arising during deformation, it is proposed, with reference to a heat exchanger having lamella fins, which are held at a distance from and parallel to each other by shaped collars on the lamella fins and which are penetrated by pipes running parallel to each other in passages through the collars, the internal diameter of the passage in each case matching the external diameter of the pipe and at least partially contacting the external periphery of the pipe, while at the same time exactly preserving the distances between the lamella fins, that tongues are distributed on the periphery of the punched rim of the passage, the free ends of the tongues are bent at an angle to the pipe projecting through the passage, and that these bent tongues provide space locating surfaces for the adjacent parallel lamella fin. Also disclosed is a heat exchanger assembly.

7 Claims, 2 Drawing Sheets

HEAT EXCHANGER WITH FINS

BACKGROUND OF THE INVENTION

The invention relates to a heat exchanger having lamella fins which are held at a distance from and parallel to each other by shaped collars on the lamella fins and which are penetrated by pipes running parallel to each other in passages through the collars, in each case the internal diameter of the passage matching the external diameter of the pipe and at least partially contacting the external periphery of the pipe.

In such a heat exchanger known from the German Offenlegungsschrift 2,123,722 the shaped collars of the lamellas are distributed in the lamella surface in order to guarantee the spacing of the lamellas from each other. This certainly produces a good degree of turbulence in the cooling air flowing through the heat exchanger, but it also gives rise to the corresponding resistance to a throughflow. However, such a resistance is undesirable, especially at the low speeds of travel of vehicles in urban traffic. If a firmer material is to be used for the lamella fins in order to increase the strength, then the rims of the shaped collars tend to rupture, because too high a demand is placed on the deformability of the material of higher strengths. Cracks in the lamella fins interfere with the heatflow, increase the resistance to throughflow, encourage corrosion and thereby reduce the useful life of the heat exchanger.

It is known from GB 2,047,399 to solder freepunched, bent tongues of lamella fins to the pipes of the heat exchangers. The heatflow is greatly hindered by the few relatively narrow bent tongues.

SUMMARY OF THE INVENTION

In order to avoid the disadvantages described, it is the object of the present invention to design a heat exchanger of the type mentioned at the beginning in such a way that the individual lamella fins are held at a distance as precisely as possible by the collars, without the collars increasing the resistance of the cooling air to throughflow, the formation of cracks in the deformed material being safely avoided even with the use of materials of higher strengths.

It is another object of the invention to provide a heat exchanger unit in the form of a unitary, hollow, cylindrically-shaped article of generally "U"-shaped cross section, said article comprising a lamella fin section with at least one lamella fin constituting one leg of said "U", a plurality of spaced apart spacer locating sections comprising the other leg of said "U", and a collar section between said lamella fin section and said spacer locating sections.

Still another object of the invention is to provide a heat exchanger assembly comprising a tubular carrier, a plurality of heat exchanger units disposed on and surrounding the tubular carrier, each of the heat exchanger units comprising a unitary, hollow, cylindrically-shaped article of generally "U"-shaped cross section; the article comprising a lamella fin section, with at least one lamella fin, constituting one leg of the "U", a plurality of spaced apart spacer locating sections constituting the other leg of the "U", and a collar section between the lamella fin section and the spacer locating section; the length of the collar section in each of the units being substantially equal; the collar sections of the heat exchanger units surrounding the tubular carrier and being in contact therewith, and the heat exchanger units abutting each other with the spacer locating sections of one unit contacting the lamella fin section of an adjacent unit.

A further object of the invention is to provide a method of making a heat exchanger unit comprising providing a flat blank, punching a hole in the blank to produce an annularly shaped rim, the inner portion of which has punched-out openings of similar size and shape leaving a plurality of spaced apart tongues of similar size and shape extending inwardly from the rim, uniformly bending at least the tongues to produce a generally cylindrically formed "L"-shaped cross section of the rim and tongues, bending the outer portion of the tongues to produce a cylindrically formed, generally "U"-shaped cross section of the rim, the bent outer portion of the tongues and the unbent inner portion of the tongues extending from the rim to the bent portion.

To achieve these objects the invention provides that the tongues are distributed on the periphery of the punched rim of the passage, the free ends of the tongues are bent at an angle to the tubular carrier (pipe) projecting through the passage, and that these bent tongues provide spacer locating surfaces for the adjacent parallel lamella ribs or fins. In this way, the spacer locating surfaces not only ensure the exact preservation of spacing, but at the same time also improve the heat conduction by increasing the area of contact in the pipe region. Preferably, the bent portion of the tongues is substantially equal to the spacing between the lamella base surface and the spacer locating surfaces in order to substantially increase the heat conduction. After bending, the passage has an unbroken cylindrical surface at least over a major portion of its axial length. The gaps between the lamella fins are otherwise free of spacers, so that the cooling air can pass through with optimally low resistance to throughflow.

A variable separation of the fins can be achieved by bending tongues at an angle of less than 90°, for example by 45°. The distance between the lamella fins then becomes larger than for bending by 90°.

An especially exact lamella distance can be achieved by equalizing the distance of the spacer locating surfaces from the lamella base surface by coining all the spacer locating surfaces of the lamella fins.

Because, depending on the pipe diameter, the number of tongues distributed is higher for a larger pipe diameter than for a smaller pipe diameter, the necessary distortion can be kept optimally low, so that no cracks are formed even when lamella fin materials of a higher strength are worked.

To achieve locating surfaces as large as possible for the heat transfer at the pipe conducting the heat carrier, the largest external diameter of the punched-out part is smaller before punching than the external diameter of the pipe. During punching, a cylindrical rim is then formed, to which the tongues are joined at the face.

To produce the lamella fins for a heat exchanger of the type mentioned at the beginning, the lamella fins are first provided with a desired pattern such as star-shaped punched-out parts, then the rims of these punched-out parts are deformed, such as by bending, together with their tongues as formed by the star shape, through 90° by means of extruding punches, and the tongues are subsequently bent outward over at least a substantial portion of their length in order to form the spacer locating surfaces.

Because of the fact that during the production of the punched-out parts the tongues are punched free and, moreover, the external contour of the punched-out part is designed to be star-shaped, the lamella fin material need not be very severely deformed when being punched to form the collar, so that stronger fin material can also be used, in order in this way to keep radiator damage as low as possible during heavy operation and cleaning work.

Further embodiments, features and advantages according to the invention are explained in more detail in the following detailed description of preferred embodiments, with reference to the attached drawings.

DETAILED DESCRIPTION OF THE PREFERRED EMBODIMENTS

Figures 1, 2, 3, 4, 5, 6, 7, 8, 9, 10, 11, 12:
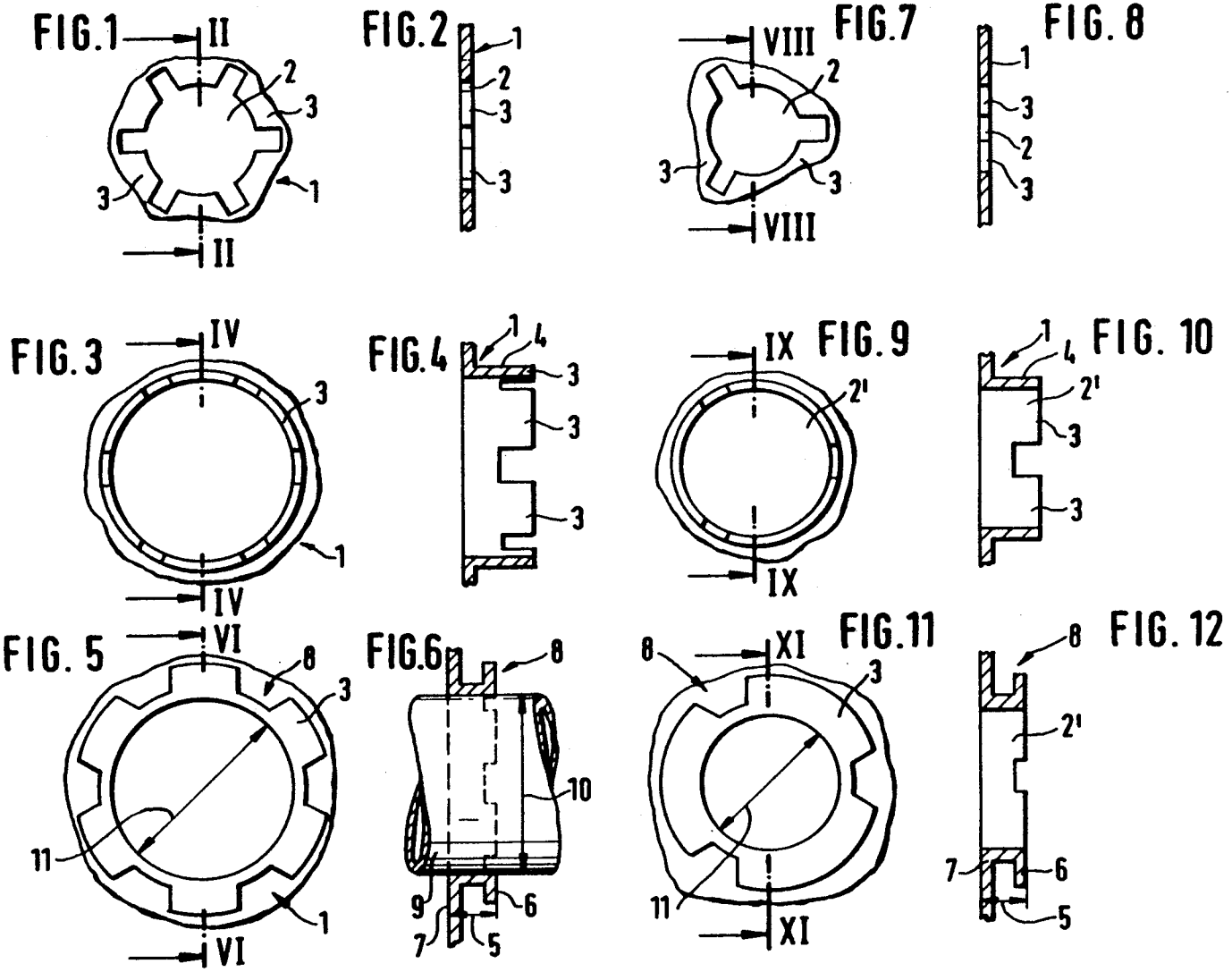
FIG. 1 is a partial plan view of a punched-out part of a lamella fin.
FIG. 2 is a partial section along the line II—II in FIG. 1.
FIGS. 3, 4 are representations corresponding to FIGS. 1 and 2 of the second work-step after the punching of the rim of the punched-out part.
FIGS. 5, 6 are representations corresponding to FIGS. 1 and 2 or 3 and 4 of the last operation in the production of the lamella fins with bent-over tongues, the pipe conducting a heat carrier being drawn in FIG. 6.
FIGS. 7 to 12 are representations corresponding to FIGS. 1 to 6 of a different embodiment with a smaller punched-out part, and correspondingly fewer tongues distributed on the periphery of the punched-out part.
Figure 13:
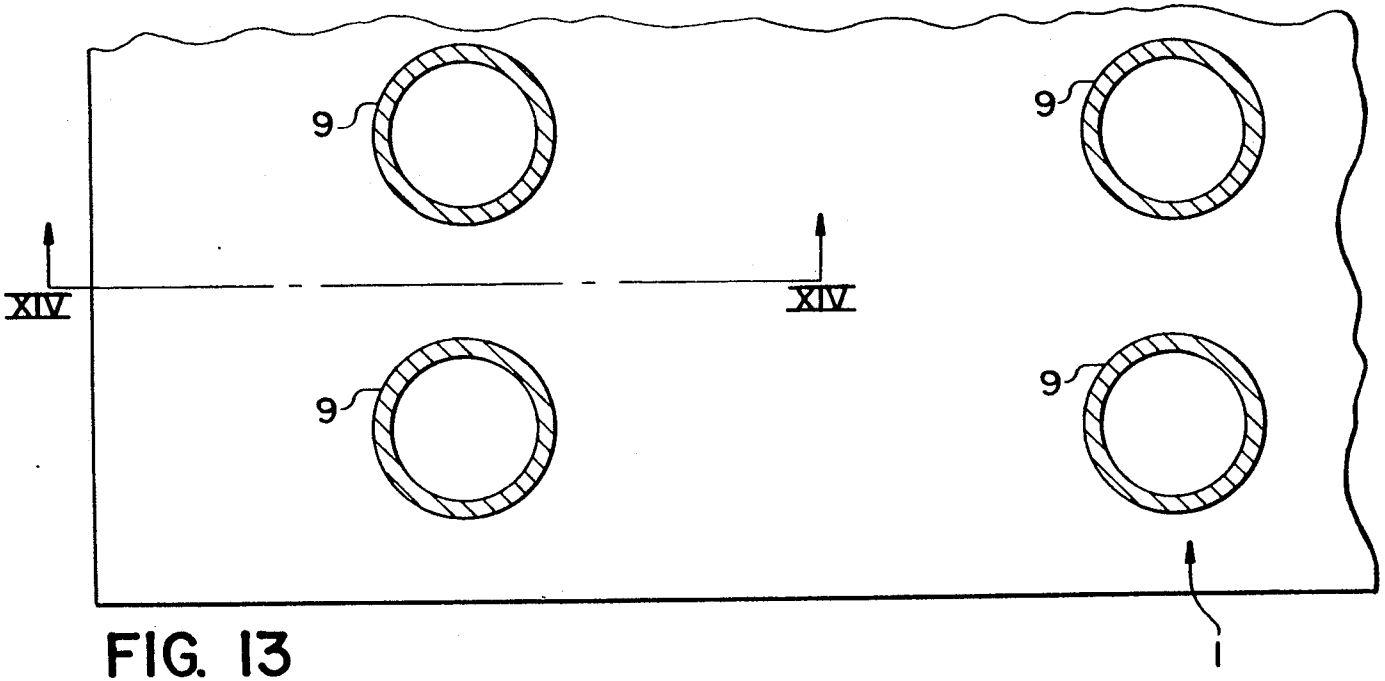
FIG. 13 is a representation of a lamella fin with inserted pipes.
Figure 14:
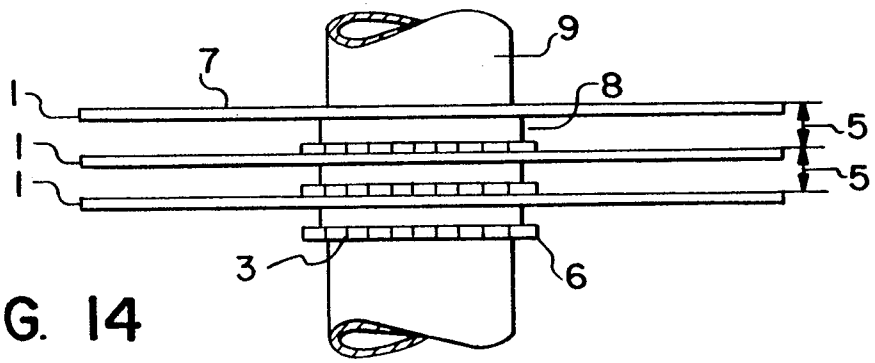
FIG. 14 is a representation of plural lamella fins assembled with an inserted pipe.

In the description which follows the same reference numerals are used for all corresponding parts.

An approximately star-shaped punched-out part 2, having tongues 3 distributed on the periphery, is produced in the sheet-metal lamella fin 1 only partially represented in a plan view in FIG. 1. In the punching process, the rim zone of the punched-out part 2 is then punched-out with the tongues 3 according to FIGS. 3 and 4, thus forming a passage 2' which is circular in the illustrative embodiments, and has a cylindrical part 4, which is joined flush by the tongues 3. According to FIGS. 5 and 6, the tongues 3 themselves are subsequently bent by 90° over a substantial portion of their length As can be seen in FIGS. 5 and 6, the bent portion is substantially equal to the spacing 5 between the lamella base surface 7 and the spacer locating surfaces 6' in order to substantially increase the heat exchange between adjacent lamella fins 1. The distance 5 from the lamella base surface 7 of the spacer locating surfaces 6 formed by the bending being equalized by coining all the collars 8 so formed of the lamella fins. After bending, the passage 2' has an unbroken cylindrical surface over a major portion of its axial length.

The lamella fins 1 so produced are then arranged parallel to each other on pipes extending parallel to each other in order to form the heat exchanger. The individual lamella fins 1 are held at the same distance from each other by the spacer locating surfaces 6, the external diameter 10 of the pipe 9 corresponding to the internal diameter 11 of the collar 8. By broadening the pipes 9 a force fit is produced, which serves a good heat transfer.

In the illustrative embodiment of FIGS. 1 to 6, the punched-out part 2 has six tongues 3, whereas in the illustrative embodiment represented in FIGS. 7 to 11 and relating to lamella fins 1 having pipes 9 with a smaller diameter only three tongues 3 are provided for each punched-out part 2. In principle, however, the design corresponds to the embodiment of FIGS. 1 to 6 in such a way that there is no need to go into a more detailed description here.

What is claimed is:

1. A heat exchanger assembly comprising a tubular carrier, a plurality of heat exchanger units disposed on and surrounding said tubular carrier, each of said heat exchanger units comprising a unitary hollow, cylindrically shaped article of generally "U"-shaped cross section; said article comprising a lamella fin section, with at least one lamella fin, constituting the first leg of said "U", a plurality of spaced apart spacer locating sections constituting the second leg of said "U", and a collar section between said lamella fin section and said spacer locating section; the length of said collar section in each of said units being substantially equal; said collar sections of said heat exchanger units surrounding said tubular carrier and being in contact therewith and said heat exchanger units abutting each other with the spacer locating sections of one unit contacting the lamella fin section of an adjacent unit; wherein the second leg of said "U" is rectangular to said collar section each spacer locating section comprises tongues separated by notches, and the length of the second leg of said "U" is substantially equal to the spacing between the lamella fin section and the spacer locating section in order to substantially increase the heat exchange between said heat exchanger units.

2. A heat exchanger having lamella fins with a lamella base surface, which are held at a distance from and parallel to each other by shaped collars on the lamella fins and which are penetrated by pipes running parallel to each other in passages through the collars, the internal diameter of the passage in each case matching the external diameter of the pipe and at least partially contacting the external periphery of the pipe, wherein tongues separated by notches are distributed on the periphery of a rim of each passage, the free ends of the tongues are bent rectangularly in relation to the pipe projecting through the passage, said bent tongues provide spacer locating surfaces for the adjacent parallel lamella fins, the distance of the spacer locating surface from the lamella base surface is the same, and the passage comprises an unbroken cylindrical surface over a major portion of its axial length produced by the steps of:

a) punching-out a star shaped hole with a predetermined diameter to produce a rim and tongues separated by notches out of a lamella base surface;

b) deforming said rim with said tongues through 90° thereby forming a collar with a passage which comprises an unbroken cylindrical surface over a major portion of its axial length;

c) bending at least a substantial portion of the length of the tongues rectangularly outwardly to form spacer locating surfaces;

d) coining all the spacer locating surfaces to provide a constant distance between the spacer locating surfaces and the lamella base surface; and e) inserting a pipe through said collar and attaching another lamella fin produced according to the steps a) to d) onto the pipe.

3. A product according to claim 2, wherein the diameter of the hole is smaller before deforming than the outer diameter of a pipe and step b) is employed by punching the pipe through said hole thereby forming said collar.

4. A product according to claim 2, further comprising the step of broadening said pipe after said pipe is inserted into said collar for producing a form fit.

5. A heat exchanger having lamella fins with a lamella base surface, which are held at a distance from and parallel to each other by shaped collars on the lamella fins and which are penetrated by pipes running parallel to each other in passages through the collars, the internal diameter of the passage in each case matching the external diameter of the pipe and at least partially contacting the external periphery of the pipe, wherein tongues separated by notches are distributed on the periphery of a rim of each passage, the free ends of the tongues are bent rectangularly in relation to the pipe projecting through the passage, said bent tongues provide spacer locating surfaces for the adjacent parallel lamella fins, the distance of the spacer locating surface from the lamella base surface is the same, and the passage comprises an unbroken cylindrical surface over a major portion of its axial length, wherein the length of the cross-section of the locating surface is substantially equal to the spacing between the lamella base surface and the locating surface in order to substantially increase the heat exchange between the lamella fins.

6. A heat exchanger as claimed in claim 5, wherein three comparably large bent tongues separated by three comparably small notches are distributed on the periphery of said rim of said passage.

7. A heat exchanger having lamella fins with a lamella base surface, which are held at a distance from and parallel to each other by shaped collars on the lamella fins and which are penetrated by pipes running parallel to each other in passages through the collars, the internal diameter of the passage in each case matching the external diameter of the pipe and at least partially contacting the external periphery of the pipe, wherein tongues separated by notches are distributed on the periphery of a rim of each passage, the free ends of the tongues are bent rectangularly in relation to the pipe projecting through the passage, said bent tongues provide spacer locating surfaces for the adjacent parallel lamella fins, the distance of the spacer locating surface from the lamella base surface is the same, and the passage comprises an unbroken cylindrical surface over a major portion of its axial length, wherein the length of the cross-section of the locating surface is of sufficient radial length to provide a significant increase in heat transfer between the locating surface and an adjacent lamella fin.

* * * * *